United States Patent [19]

Westcott

[11] Patent Number: 4,486,731

[45] Date of Patent: Dec. 4, 1984

[54] COIL ASSEMBLY WITH FLUX DIRECTING MEANS

[75] Inventor: Vernon C. Westcott, Lincoln, Mass.

[73] Assignee: Sensormatic Electronics Corporation, Deerfield Beach, Fla.

[21] Appl. No.: 386,886

[22] Filed: Jun. 10, 1982

[51] Int. Cl.[3] ..... H01F 27/24

[52] U.S. Cl. ..... 336/212; 336/215; 336/221; 336/232; 235/492; 235/493

[58] Field of Search ..... 336/212, 214, 215, 221, 336/232

[56] References Cited

U.S. PATENT DOCUMENTS

| | | | |
|---|---|---|---|
| 3,448,440 | 6/1969 | Wiegand | 343/6.8 R X |
| 3,521,280 | 7/1970 | Janco et al. | 343/6.5 SS |
| 3,624,311 | 11/1971 | Emden | 340/825.31 |
| 3,634,799 | 1/1972 | Straugh | 336/212 X |

FOREIGN PATENT DOCUMENTS

| | | | |
|---|---|---|---|
| 552778 | 4/1943 | United Kingdom | 336/212 |

*Primary Examiner*—A. D. Pellinen
*Assistant Examiner*—S. Steward
*Attorney, Agent, or Firm*—Hopgood, Calimafde, Kalil, Blaustein & Judlowe

[57] ABSTRACT

A coil assembly with reduced anisotropy has a pancake type loop winding of one or more turns with which is interrelated one or more strips or bodies of magnetically permeable material. The permeable material provides as compared with air a lower reluctance flux path that passes through the pancake coil from one side to the other thereof. The permeable strips are shown and described generally in the shape of an open or interrupted "cross".

6 Claims, 7 Drawing Figures

COIL ASSEMBLY WITH FLUX DIRECTING MEANS

BACKGROUND OF THE INVENTION

The present invention relates to a coil assembly for use in a communication system. More particularly it relates to a coil assembly for use in a communication system in which the spacial orientation of the coil assembly relative to other components in the system can not be predetermined.

There exist numerous communication systems in which communication is to be established between two or more components by means of a linking magnetic field and in which at least one of the components is movable relative to another such that isotropic sensitivity is important for maintaining communication. The need for isotropic response in paging systems and article surveillance systems, to name two examples, should be readily apparent.

Assuming that communication is to be established either to or from a loop coil by means of an AC magnetic field the problem exists of ensuring adequate magnetic coupling between the coil and the field regardless of the spacial orientation of the coil relative to the lines of flux constituting the field. It is well known, for example, that a flat coil immersed in a magnetic field wherein all the lines of flux are parallel to the plane of the coil will experience little or no magnetic coupling with such field. On the other hand, if the coil is used to produce the field, the lines of flux will be oriented normal to the general plane of the coil and not parallel thereto. The action of such coil is clearly anisotropic and null conditions will exist in any communication system in which the spacial orientation of the coil can not be predetermined.

SUMMARY OF THE INVENTION

It is, therefore, an object of the present invention to reduce the null relationships of the type mentioned above and to produce a coil assembly having less anisotropy than coils known heretofore. In accordance with said invention there is provided a coil assembly, including a coil, for use in a communication system in which coupling between said assembly and another communication component is to be established by linking said coil of said coil assembly with said component by a magnetic field, said coil having electrically conductive turns assembled in the form of a flat pancake shape loop encircling a central axis and having a thickness dimension parallel to said axis substantially less than its dimension normal to said axis, and a plurality of strips of magnetically permeable material disposed each overlapping a different circumferential area of said coil with at least a first and second one of said strips located on opposite sides of and generally parallel to an imaginary plane that is normal to said axis and which generally bisects said thickness dimension, said strips being interrelated with said coil for providing a low reluctance flux path that passes through said plane from one side to the other side thereof for inductively linking said coil with the lines of magnetic flux making up said magnetic field when said plane is oriented parallel to said flux lines.

BRIEF DESCRIPTION OF THE DRAWINGS

The invention will be better understood after reading the following detailed description of the presently preferred embodiment thereof with reference to the appended drawings in which.

DETAILED DESCRIPTION OF THE PREFERRED EMBODIMENT

Figure 1:
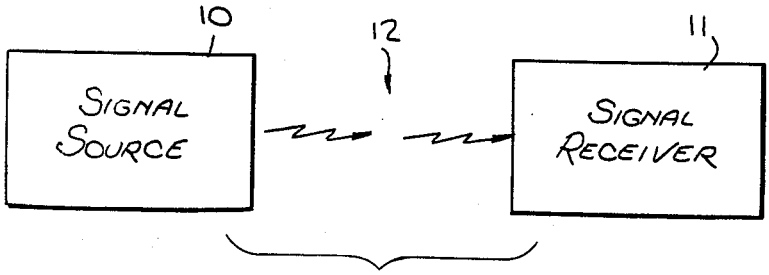
FIG. 1 is a block diagram of a communication system in which the components are linked by a magnetic field.

The same reference numerals are used throughout the drawings to designated the same or similar parts.

Referring to FIG. 1, there is shown a signal source 10 linked to a signal receiver 11 by magnetic waves 12 passing therebetween. The source 10 and receiver 11 may be components of any known communication system in which coupling is provided between the components by a magnetic field. As mentioned previously, an example is a paging system, and in such systems the page is in the form of a small receiver, usually no larger than a pack of cigarettes, that is carried by an individual as the individual goes about his or her business. Consequently, the spatial orientation of the page relative to the source of signals will be changing continually. A similar situation will be found in various other communication systems.

Figure 2:
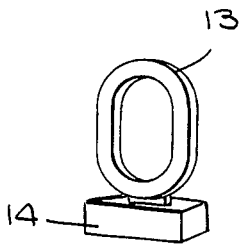
FIG. 2 is a diagrammatic view of a pancake coil assembly and its associated circuitry illustrative of the environment in which the present invention can be used.
Figure 3:
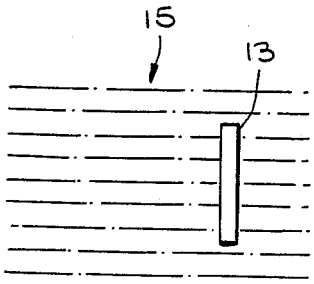
FIG. 3 is a diagrammatic illustration showing a pancake coil in one orientation relative to the lines of flux existing in a magnetic field.
Figure 4:
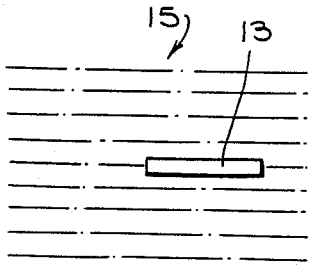
FIG. 4 is a view similar to FIG. 3 but showing the flux relationship for another orientation of the coil assembly.

For purpose of illustration, assume that the signal receiver 11 has a flat pancake type loop coil or winding 13 connected to appropriate circuitry 14, as shown in FIG. 2. Assume further than the coil 13 is immersed in a magnetic field as shown in FIG. 3 wherein coil 13 is viewed from above and the lines of magnetic flux are substantially as shown by the broken lines 15. That is, all of the lines of flux are substantially parallel to each other and perpendicular or normal to the plane of coil 13. This will be referred to as the normal case, and for such case, it will be readily appreciated that maximum flux linkage between coil 13 and flux 15 occurs. But if the coil 13 is oriented such that its plane is parallel to the lines of flux in which it is immersed, as shown in FIG. 4, the magnetic coupling or linkage would ordinarily be zero or at least negligible. This will be referred to as the parallel case.

Figure 5:
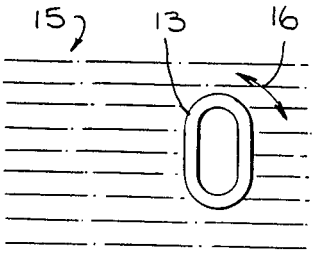
FIG. 5 is a side view of the coil of FIG. 4 for illustrating certain additional orientations of the coil assembly.

Viewed from the side as shown in FIG. 5, the coil 13 can be rotated a full 360° about its axis as shown by the arrow 16 without increasing the magnetic coupling. Reference hereinafter to a null orientation should be understood as meaning that orientation with respect which minimum magnetic linkage is encountered.

Figure 6:
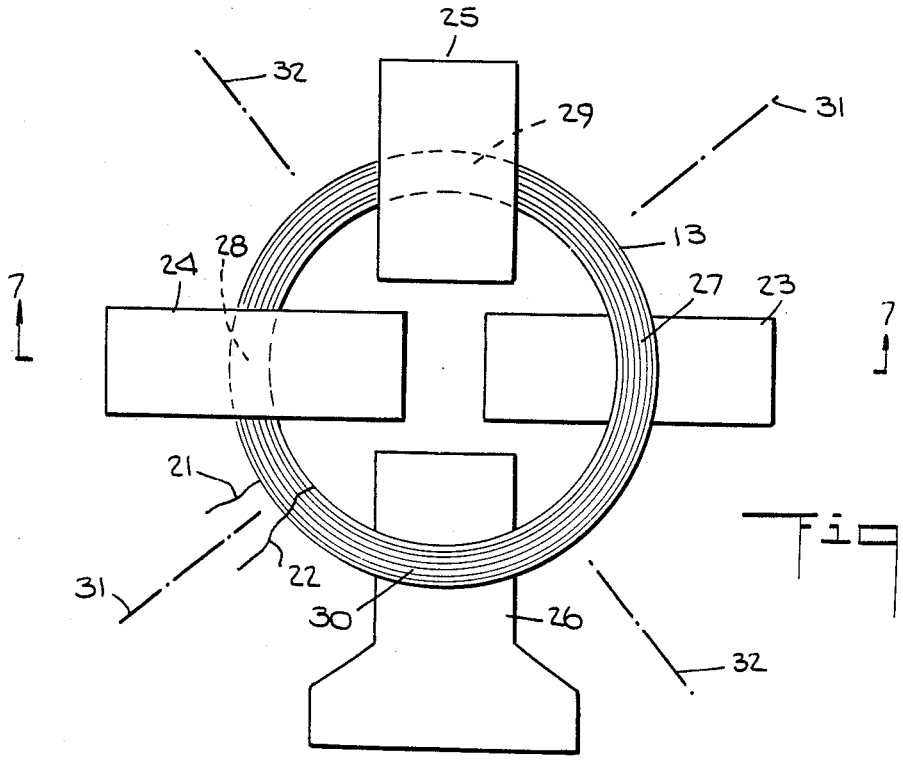
FIG. 6 is a front elevational view of a coil assembly constructed in accordance with the present invention.
Figure 7:
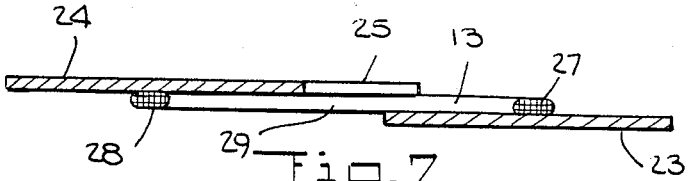
FIG. 7 is a transverse sectional view taken along the line 7—7 in FIG. 6.

Inviting attention to FIGS. 6 and 7 there is illustrated one example of a coil embodying the present invention. A flat coil 13 is provided having end terminals 21 and 22. A plurality of thin strips of magnetically permeable material, here shown as the four strips 23, 24, 25 and 26, are assembled with coil 13. The strips 23 to 26 may be formed of a ferrite material or the like, and may be united with the coil 13 by a suitable adhesive or bonding agent.

As shown in the drawings, the strip 23 extends from a point located on one side of pancake coil 13 beyond its radially outermost perimeter inwardly toward the axis and parallel to the general plane of said coil 13 across the adjacent coil turns at 27. The strip 24 is disposed generally collinearly with regard to strip 23 but on the opposite side of the coil 13, also extending from a point located beyond the radially outermost perimeter of coil 13 inwardly toward the axis and parallel to the general plane of said coil across the adjacent coil turns at 28.

In similar fashion the strips 25 and 26 overlie portions of the coil at 29 and 30, respectively, one on each side of the coil and generally collinear but oriented with their long axes related orthogonally to the long axes of strips 23 and 24. For a reason to be discussed below, one or more of the permeable strips may be of a different size and shape from the others.

When the coil assembly of FIGS. 6 and 7 is placed in a magnetic field, flux in a direction normal to the plane of coil 13 will link with the coil in the usual manner with the permeable strips having negligible effect. However, if the coil 13 is oriented as in FIG. 4 with its plane parallel to the magnetic flux lines the following situation arises. When the coil assembly is oriented with the longitudinal axes of strips 23 and 24 coinciding with the direction of the flux, the flux will "see" a lower reluctance path via strips 23 and 24 through the plane of coil 13 than through the surrounding air thereby being diverted through coil 13 into linking relationship. FIG. 5 shows the coil assembly in just such relationship. Since the strips 25 and 26 are orthogonally related to strips 23 and 24 and are on opposite sides axially of the coil, their net contribution will be insignificant. But if the coil 13, still parallel to the field flux, is rotated in the direction of arrow 16 through 90°, the flux will now pass via strips 25 and 26 through the plane of the coil.

It is possible, however, to orient coil 13 in the field 15 such that two or more flux paths link the coil. In such case, a null situation can be encountered. To be more specific, as the coil 13 is rotated about an axis normal to its plane and while its plane is parallel to the lines of flux in the field 15, two nulls or dips will occur 180° apart. Such nulls will occur when the flux lines 15 coincide with the orientation indicated by the broken line 31 in FIG. 6. The reason for the null should be apparent. In the absence of the strips 23–26 there would exist no flux linkage with coil 13. Flux travelling generally parallel to line 31 would be confronted with several low reluctance paths. One path traverses strips 24 and 25 in series on one side axially of coil 13, another path traverses strips 23 and 26 in series on the other side axially of coil 13, neither of which paths link coil 13. A further path involves strips 23 and 24 in series, while yet another path involves strips 25 and 26 in series, but the two last mentioned paths link with coil 13 such as to induce voltages therein in phase opposition. Hence, the null condition.

When the coil 13 is rotated 90° in either direction such that the flux is aligned with the broken line 32, the opposite condition prevails. Strips 23 and 26 will now be functioning in parallel cooperating with strips 24 and 25 also functioning in parallel to provide low reluctance paths passing through coil 13 in phase coherence with respect to voltages induced in coil 13.

Observing FIG. 6, it should be noted that the lines 31 and 32, while orthogonal to each other, are not located along the bisectors of the angles formed between the longitudinal axes of the strips 23–26, but are offset somewhat. Such offset is due to the departure from symmetry introduced by altering the size and shape of strip 26. The particular size and shape relationship shown in FIG. 6 is only by way of example and is dependent upon the desired locations of the null points. That is, depending upon the intended use of the coil assembly, there may be certain locations for the null positions that are less objectionable than others. In such case, a certain degree of control can be exercised through judicious choice of strip shape and size.

From a purely theoretical standpoint the null points can be eliminated if the apparatus can be arranged such that when, due to the orientation of the coil relative to the magnetic field, the amplitude of the flux passing through the center area of the coil via the permeable strips is equal to the amplitude of the flux passing through said center area independent of said strips, the phases of the voltages induced in said coil due to the two flux components are not 180° out of phase. Even slight departure from the 180° relationship will result in a significant net signal at that coil orientation. At some other orientation the phase difference between the two induced voltages may be equal to 180° but in that case the amplitudes will no longer be equal thereby avoiding a deep null at that point.

Some control over the phase relationship can be obtained by choosing permeable strips in which eddy currents are developed in use. The eddy currents tend to delay the flux cycle in the strips. For example, a permalloy strip having a thickness of 0.010" will have sufficient eddy currents induced therein at 25 KHz to introduce a significant phase shift. It is also desirable to have a phase difference between the two sets of permeable strips and this can be achieved by employing differing ratios of thickness to width as between the strips.

While the above description has been related to the use of coil 13 in a signal receiving situation, it should be apparent that the principles implicit therein can be applied with similar advantage of the signal transmitting case.

It should be understood that any suitable coil construction of pancake form can be employed effectively with its anisotropy reduced by the use of the permeable strips as described herein. Any material having a greater permeance than air can be used to some advantage for the strips. Because the higher permeability materials are more efficient, the final selection will be influenced by considerations of cost, size and weight.

Having described the present invention with reference to the presently preferred embodiment thereof, it will be understood by those skilled in the art that various changes in construction can be incorporated without departing from the true spirit of the invention as defined in the appended claims.

What is claimed is:

1. A coil assembly, including a coil, for use in a communication system in which coupling between said assembly and another communication component is to be established by linking said coil of said coil assembly with said component by a magnetic field, said coil having electrically conductive turns assembled in the form of a flat pancake shape loop encircling a central axis and having a thickness dimension parallel to said axis substantially less than its dimension normal to said axis, and a plurality of strips of magnetically permeable material disposed each overlapping a different circumferential area of said coil with at least a first and second one of said strips located on opposite sides of and generally parallel to an imaginary plane that is normal to said axis and which generally bisects said thickness dimension, said strips being interrelated with said coil for providing a low reluctance flux path that passes through said plane from one side to the other side thereof for inductively linking said coil with the lines of magnetic flux making up said magnetic field when said plane is oriented parallel to said flux lines.

2. A coil assembly according to claim 1, characterized in that at least said first strip has an end and is disposed with said end at a point located beyond the radially outermost perimeter of said coil on one side of said plane, and said first strip extends from said point inwardly toward said axis of the coil across the turns of the adjacent portion of the coil and terminates at a second end before reaching said axis.

3. A coil assembly according to claim 2, characterized in that said first and second strips each has a longitudinal axis, and said first and second strips and disp with their longitudinal axes orthogonally related.

4. A coil assembly according to claim 2, charac ized in that said first and second strips each has a lo tudinal axis, and said first and second strips are disp with their longitudinal axes generally collinearly ented.

5. A coil assembly according to claim 4, charac ized in that a third and fourth one of said plurli strips, each with a longitudinal axis and located on posite sides of said plane, are disposed with their res tive axes generally collinearly oriented relative to other and orthogonally related to the longitudinal of said first and second strips.

6. A coil assembly according to claim 1, charac ized by at least one of said plurality of strips bein sufficient thickness at the operating frequency to pe the generation of eddy currents therein for shifting phase of that voltage that is induced in said coil result of flux that links said coil over a first path, rela to that voltage that is induced in said coil as a resu flux that links said coil over a second path diffe from said first path.

* * * * *